US008083327B2

(12) United States Patent
Leighton et al.

(10) Patent No.: US 8,083,327 B2
(45) Date of Patent: Dec. 27, 2011

(54) HOT MELT INK DELIVERY RESERVOIR PUMP SUBASSEMBLY

(75) Inventors: Roger G. Leighton, Rochester, NY (US); Gerald A. Domoto, Briarcliff Manor, NY (US); Brian D. Bitz, Sherwood, OR (US); Kirk S. Edwards, Rush, NY (US)

(73) Assignee: Xerox Corporation, Norwalk, CT (US)

( * ) Notice: Subject to any disclaimer, the term of this patent is extended or adjusted under 35 U.S.C. 154(b) by 1186 days.

(21) Appl. No.: 11/829,196

(22) Filed: Jul. 27, 2007

(65) Prior Publication Data

US 2009/0027458 A1 Jan. 29, 2009

(51) Int. Cl.
*B41J 2/045* (2006.01)

(52) U.S. Cl. ..... 347/71

(58) Field of Classification Search ..... 347/71, 347/70, 72, 68–69, 44
See application file for complete search history.

(56) References Cited

U.S. PATENT DOCUMENTS

| | | | | |
|---|---|---|---|---|
| 4,882,596 | A * | 11/1989 | Tsuzuki et al. | 347/68 |
| 5,371,529 | A * | 12/1994 | Eguchi et al. | 347/68 |
| 7,837,306 | B2 * | 11/2010 | Fujishiro | 347/72 |
| 2006/0152557 | A1 * | 7/2006 | Silverbrook et al. | 347/72 |

* cited by examiner

*Primary Examiner* — Kristal Feggins
(74) *Attorney, Agent, or Firm* — Marger Johnson & McCollom, P.C.

(57) ABSTRACT

A print head pump assembly has a piezo element plate having an array of piezoelectric elements, a channel plate having an array of channel regions corresponding to the array of piezoelectric elements, and a valve plate having an array of reed valve pairs corresponding to the array of channel regions. A print head assembly has at least one ink reservoir, an upper routing plate to receive ink from the ink reservoir, a lower routing plate to direct ink out of the print head, and a pump assembly to draw ink from the upper routing plate and deliver ink to the lower routing plate using piezoelectric diaphragms. A method of delivering ink to a print substrate includes providing ink to a low-pressure reservoir of a print head, drawing ink out of the low-pressure reservoir through an upper routing plate using a pump assembly internal to the print head, and pumping ink out of the print head through a lower routing plate using the pump assembly, such that the drawing and pumping processes continuously alternate.

7 Claims, 6 Drawing Sheets

HOT MELT INK DELIVERY RESERVOIR PUMP SUBASSEMBLY

BACKGROUND

Ink delivery systems generally deliver ink from a reservoir to ports on a print head. The ink travels through umbilicals or tubing, enters the printhead and then ends up on a printing substrate as selected by the delivery system within the print head. In hot melt ink printers, the ink takes the form of solid 'sticks' of ink that is then melted into a first reservoir. Depending upon the configuration of the printer, the ink may travel from the first reservoir to a smaller reservoir closer to the print head until print demand requires delivery of the ink to the print head.

Some current implementations of piezoelectric ink jet (PIJ) printers may use an ink delivery system to deliver ink to 16 ports on the print head asynchronously. These systems may contain 16 solenoid valves, air router manifolds, low and high pressure chambers, check valve disks, check ball assemblies and fluid routing plates. An air pulse drives the ink from the solenoid in a single plug flow, in some embodiments the flow was only 0.6 grams per sec. The introduction of the pressurized air pulses can cause foaming, overfill, and print head leakage or 'drooling' if more than 2 colors are simultaneously delivered to a single head.

Further, this implementation has limitations as to the maximum flow rate of the ink and the number of colors that can be delivered to the print heads simultaneously. The print head also has a higher than desirable impulse pressure and several parts, as listed above.

DETAILED DESCRIPTION OF THE EMBODIMENTS

Figure 1:
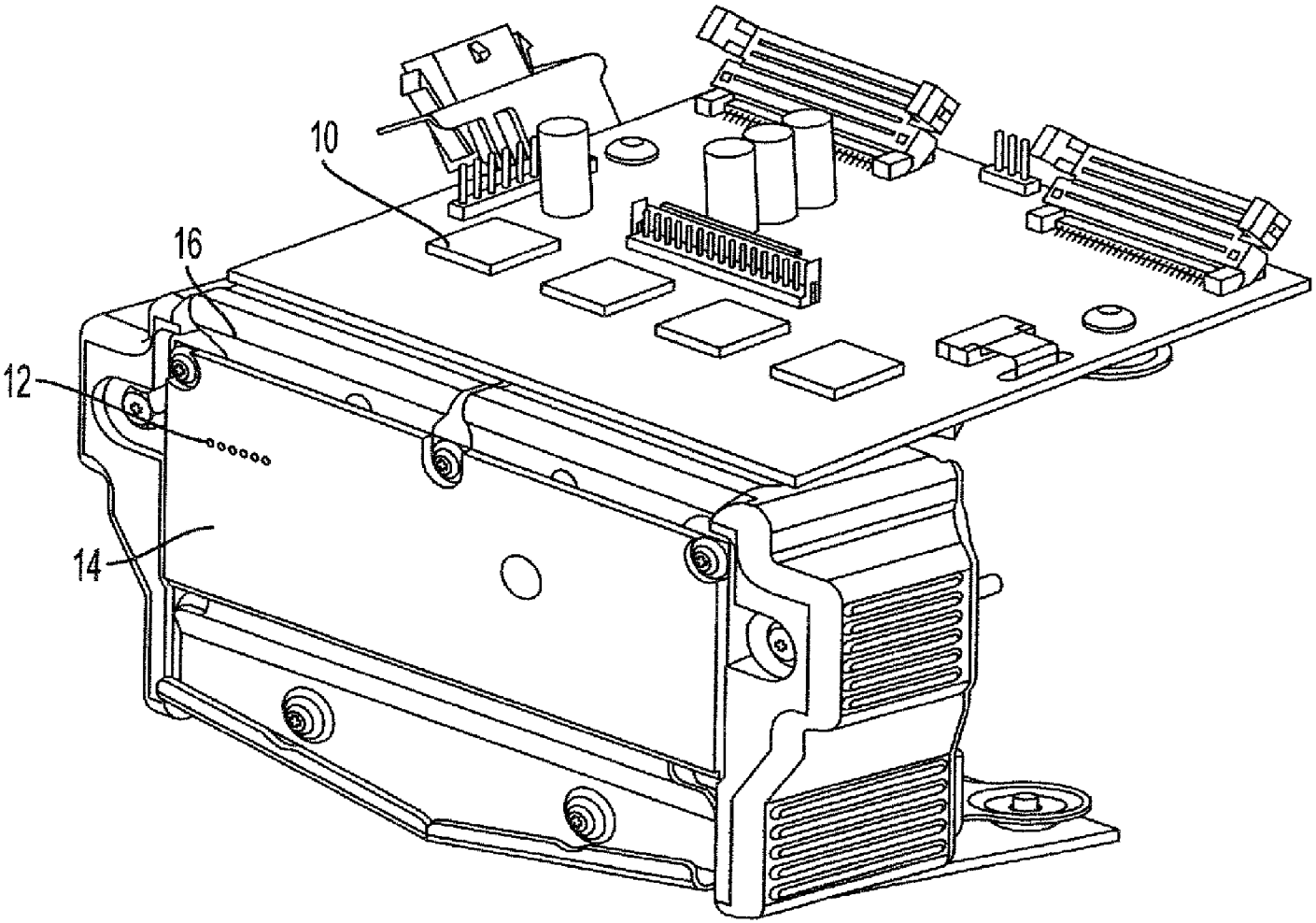
FIG. 1 shows an example of a current ink jet print head.

FIG. 1 shows an example of an ink jet print head. The print head has an ink reservoir 10 that receives ink from an ink source, not shown. In the case of a hot melt ink jet printer, the ink source generally consists of solid ink sticks melted by a heat source of some kind and then pumped to the ink reservoir such as 10. In typical ink jet printers, pressurized air provides the impetus to move the ink from the melting reservoir to the print head ink reservoir 10. For that reason, the print head ink reservoir may also be referred to as a high-pressure reservoir.

The print head ink reservoir may actually consist of several ink reservoirs, one for each color standard to the color printing process, cyan, yellow, magenta and black. The ink travels from the reservoirs through a series of outlet plates and manifold plates that route the ink to an array of jets such as 12 on an aperture plate or jet stack 14. A control circuit 16 controls the exit of the ink through the jet stack to form drops of ink on a print substrate, subsequently forming an image. The control circuit 16 may consist of a flex circuit. The ink passes through all of these plates by pressurized air.

As mentioned previously, using pressurized air as a delivery system throughout the print head may cause performance issues, including limitations on max flow rate. Using a low-pressure reservoir to drip the ink into an internal pump assembly, one can maintain a higher flow rate without the issues presented by the use of pressurized air. An embodiment of such as print head is shown in FIG. 2.

Figure 2:
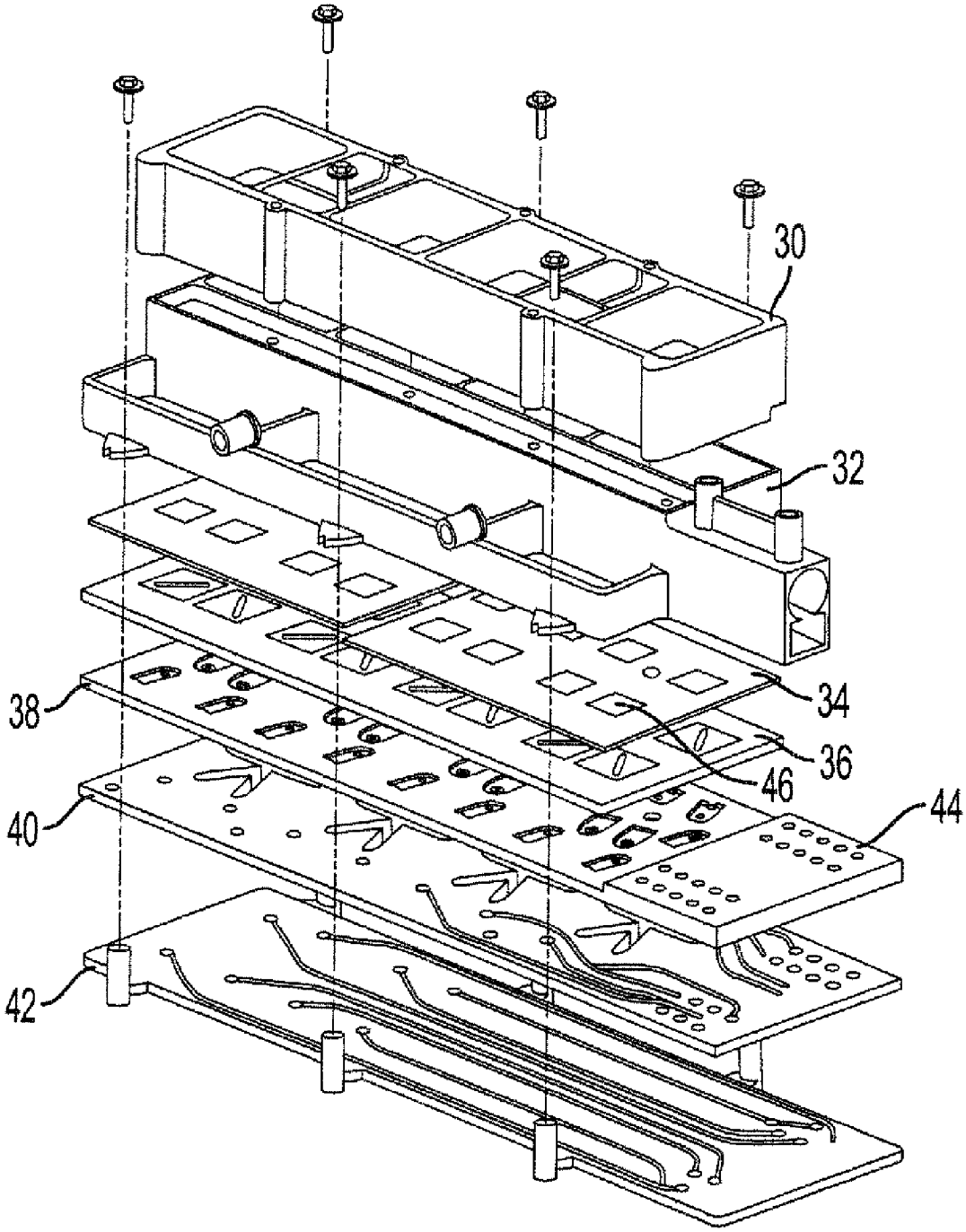
FIG. 2 shows an exploded view of an embodiment of an ink jet print head having a pump assembly.

In FIG. 2, a low pressure ink reservoir mates to the high pressure ink reservoir such as the one shown previously. The high pressure reservoir may take many forms and the example of FIG. 1 is just one of many options. The low pressure reservoir 30 may consist of several individual reservoirs, such as those shown in FIG. 2, one for each color. The low pressure reservoir resides in a low pressure housing 32. The flex circuit (not shown), similar to that shown in FIG. 1 but for control of the diaphragm elements on the diaphragm plate 34, may reside between the low pressure reservoir housing 32 and the diaphragm plate 34.

The diaphragm plate 34 comprises one part of an internal pump assembly discussed in more detail later. A lower diaphragm plate, or channel plate 36, mates with the diaphragm plate 34. A valve plate 38, such as that shown in FIG. 3, also mates and bonds with the channel plate. An upper routing plate 40 and a lower routing plate 42 complete the print head assembly.

In operation, ink drips from the low pressure reservoirs into the port that feeds the reed valves on the reed plate 38 to the upper routing plate 40. The ink diverts into channels on the upper routing plate. The diaphragm plate 34 has an array of piezo diaphragm elements such as 46. When activated, the diaphragm element extends 'upwards' towards the low pressure reservoir 30, drawing the ink from the upper routing plate through intake one-way valves on the valve plate 38. When the diaphragm elements collapse, the intake one-way valves close, and the outlet one-way valves open, pushing the ink to the lower routing plate 42, which then channels the ink to the jet stack and ultimately onto the print substrate.

In order to facilitate the process, many of the plates have features that provide the necessary elements for correct operation of the pump assembly. In this embodiment, the pump assembly consists of the diaphragm plate, the channel plate and the valve plate. The side view of FIG. 3 show features that facilitate pump operation.

For example, the backside of the low pressure housing 32 has clearance pockets such as 48 to allow the membranes elements to expand upward. As can be seen in the backside of the channel plate 36, seals are provided such as 50 for the one-way, or reed, valves. The importance of these seals will be discussed further.

Figure 3:
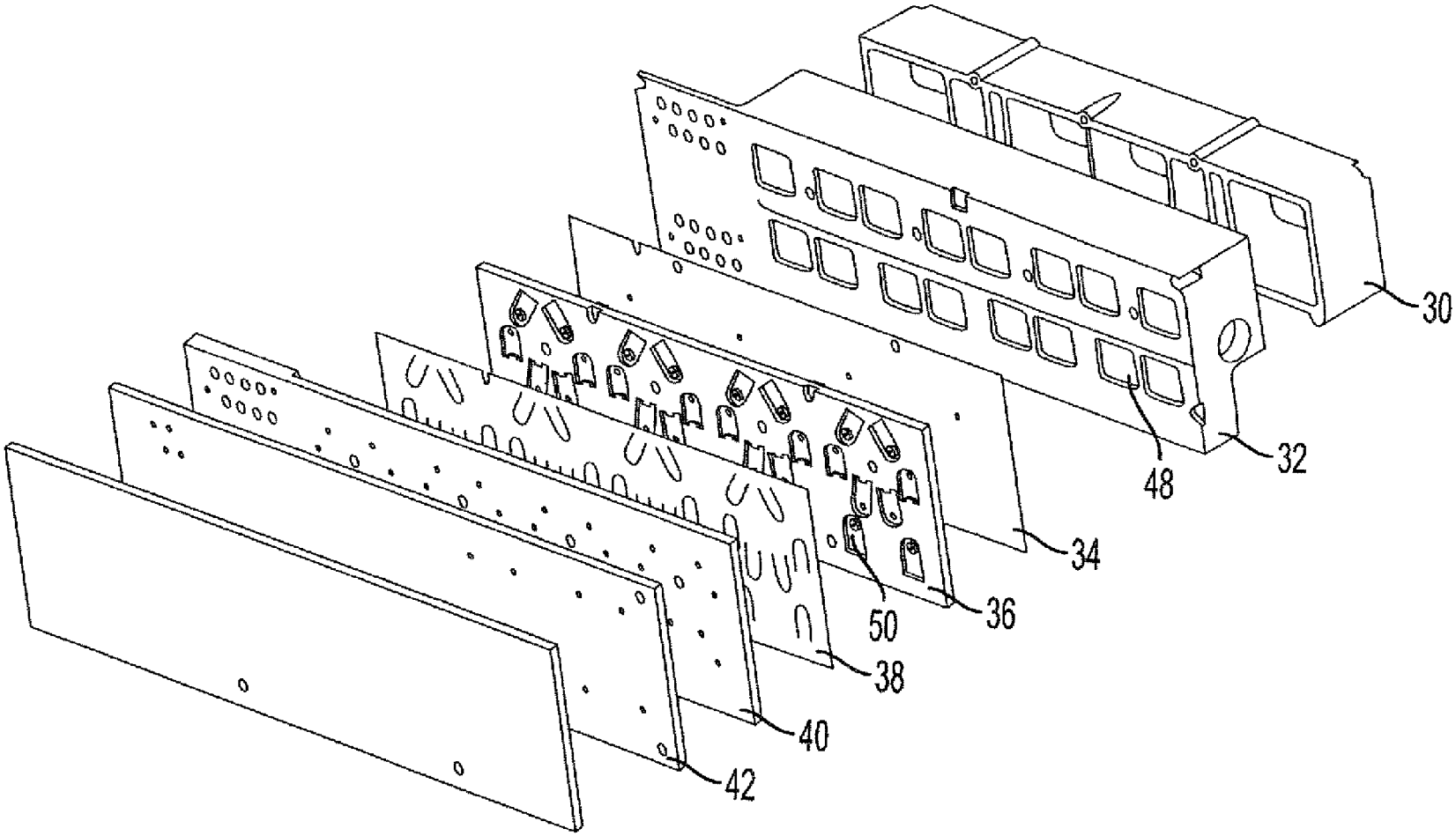
FIG. 3 shows a side exploded view of an embodiment of an ink jet print head having a pump assembly.
Figure 4:
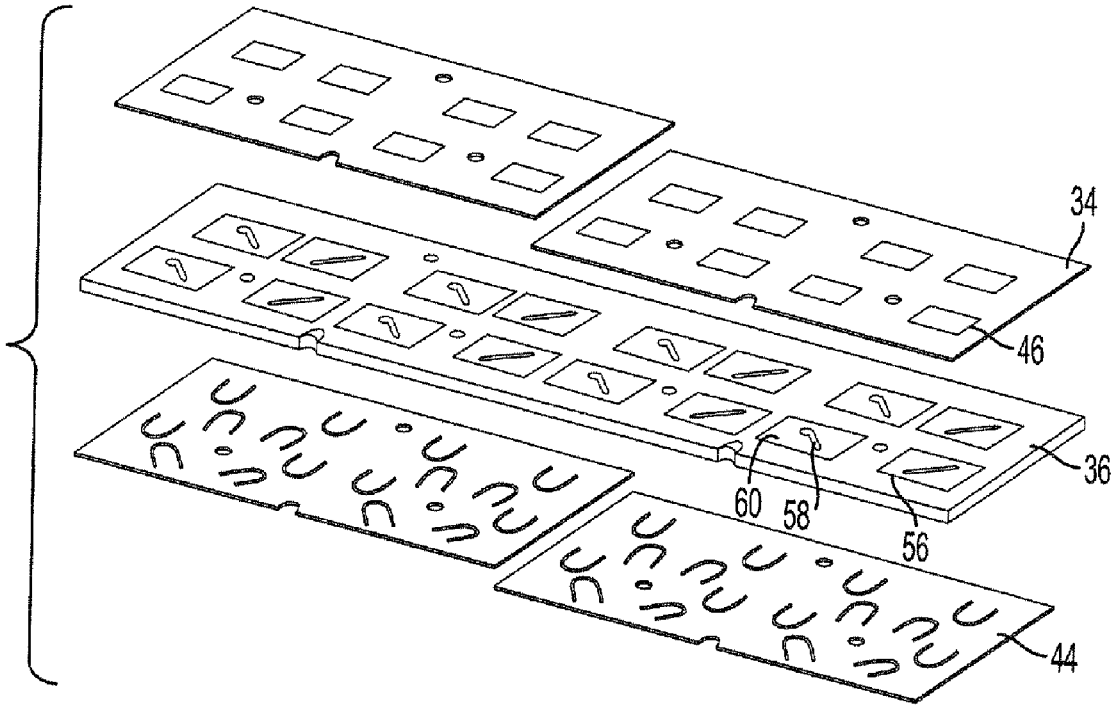
FIG. 4 shows an exploded view of a pump assembly.

FIG. 4 shows a more detailed view of the pump assembly internal to a print head assembly such as that shown in FIGS. 2 and 3. The diaphragm plate 34 has an array of membrane elements, piezoelectric elements such as 46 in this embodiment. When an electric voltage is applied to the element, the membrane either expands upwards or collapses downwards. For purposes of the discussion here, since the membrane expands upwards to draw the ink and then collapses to pump the ink downwards delivering ink to the print head, the voltage may first be applied to the membrane and then altered to cause the collapse.

The piezoelectric elements on the diaphragm plate correspond to channel regions such as 56 on the channel, or lower diaphragm, plate 36. The channel regions may consist of cavities having a concave shape to allow the diaphragm to collapse into the regions. The channel regions in this embodiment also have a port 60 and channel 58 in the concave region to allow ink flow and temporary pooling.

The valve plate 44 may consist of one-way valve pairs. The discussion may also refer to the one-way valves as reed valves. The valve pairs correspond to the channel regions such as 56 on the channel plate 36. One valve in each pair would be an intake or inlet valve and the other valve would be an outlet valve. As the membrane expands upwards, the intake valve would allow the ink to flow upwards. As the membrane collapses, the pressure would cause the intake valve to close and the outlet valve to open, pushing the ink to the lower routing plate, not shown in FIG. 4, but discussed below with regard to FIG. 6.

Figure 5:
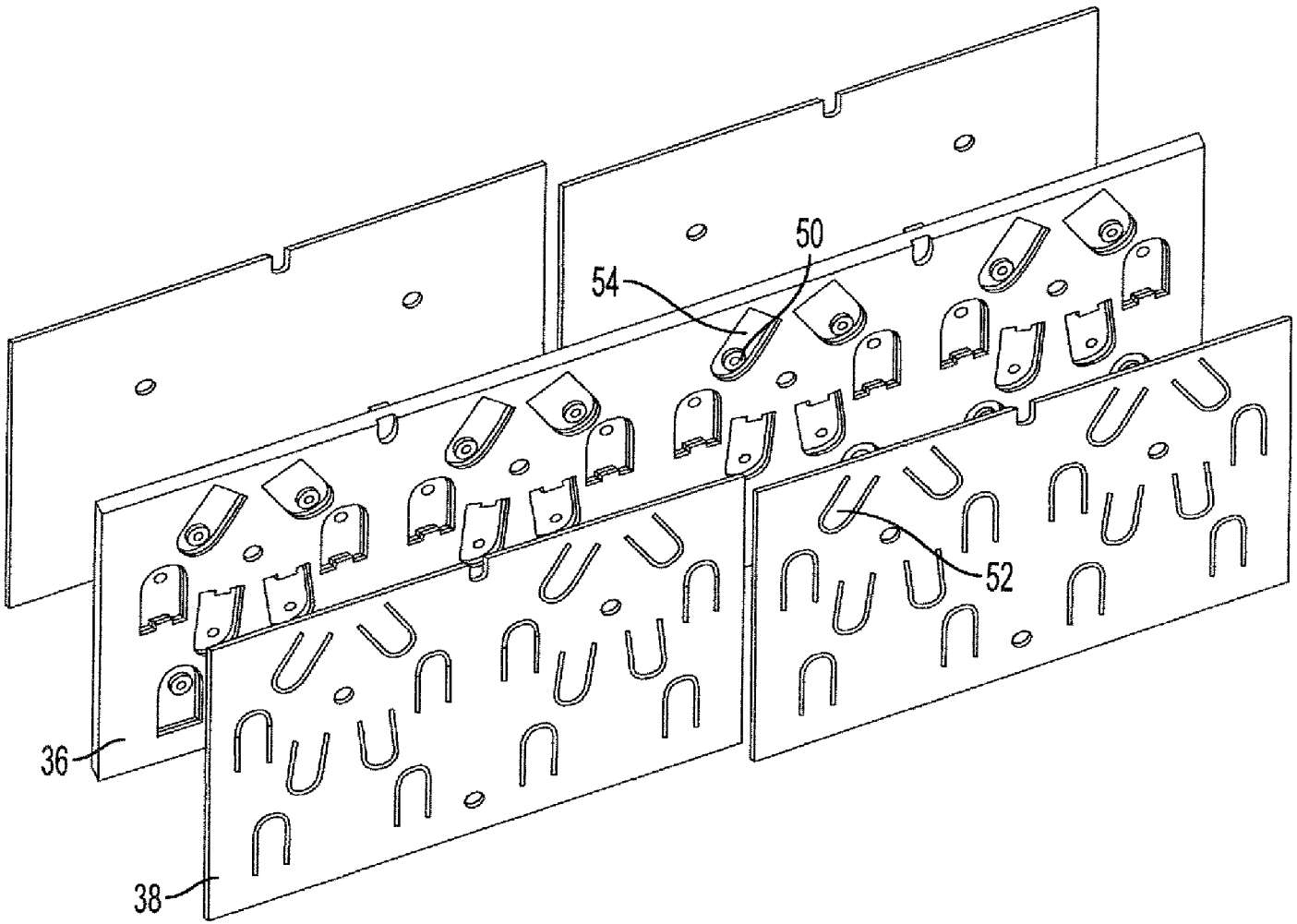
FIG. 5 shows a side exploded view of a pump assembly.

FIG. 5 shows a side view of the pump assembly. This view more clearly shows the outlet seal ports such as 50 in the valve inset 54 on the back side of the channel plate 36. This particular example corresponds to intake valve 52 on the valve plate 38. For optimal results, the inlet and outlet seals operate to build internal cavity pressure in this annular seal area shown as 50. The size of the annular area of the seal should be determined such that it is small enough to overcome the viscosity squeeze film adhesion forces of the ink, yet large enough to create a solid seal for internal pressure. A small leak rate through the reed valve is allowable and will prevent back flow in the ink delivery umbilicals towards the low pressure reservoir during a purge cycle. The small leak rate will not prevent internal cavity pressures from reaching the dynamic peak pressure due to instantaneous sealing forces on the valve seat. The valve seat uses a machining technique to create the correct surface structure to allow for proper sealing and quick release. Solid ink printers generally undergo periodic purge cycles to eliminate any particles resulting from cooling ink that may adversely affect operation of the printer.

Figure 6:
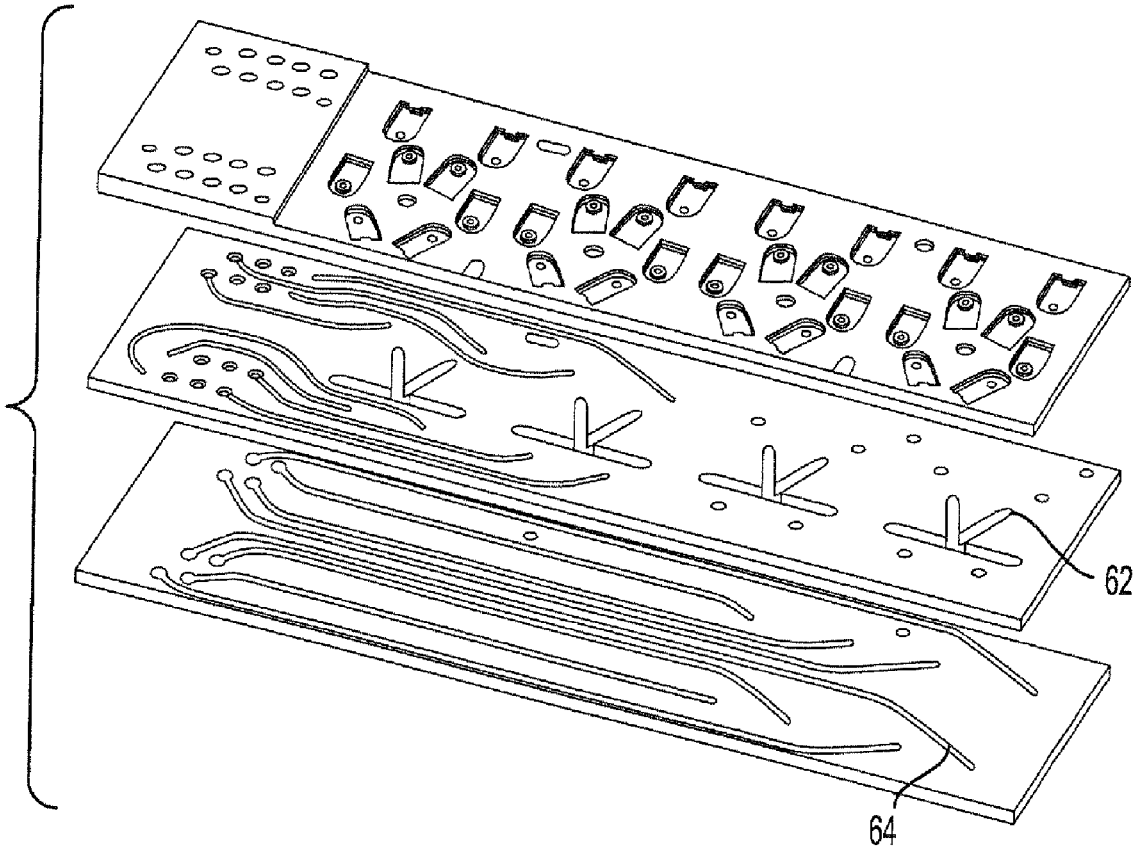
FIG. 6 shows an exploded view of a set of outlet plates for an ink jet print head.

FIG. 6 shows the connection points for the umbilicals that pass ink through the reed plate to the upper routing plate. The channels, such as 62, route the ink to regions below the intake valves to allow uptake of the ink during membrane expansion. When the membrane collapses, the ink is pushed through to the lower routing plate channels such as 64, and then ultimately to the jet stack, not shown. The channels feed the array of jets such as that shown in FIG. 1.

In experiments, a voltage waveform at 525 volts at 25 to 35 Hz was applied to the elements with a 150 volt offset to bias the elements in compression to prevent piezo cracking. The bias limits the deflection height of the piezo reducing total tension strains. The waveform was optimized for a 40% dwell time with sinusoidal transitions to smooth the stress fluctuations and lower shock loads at the intake and pump processes. A flow rate of 4.4 grams per minute was achieved at 7 pounds per square inch with 20 inch head pumping through a 36 inch tube of 0.078 inch diameter, and a flow rate of 6.0 grams per minute was achieved at 7.4 pounds per square inch with 1 in head pumping through the same dimensioned tube. This produced a 75 micrometer diaphragm deflection with a piezo 5H material that has higher deflection/volt response than other materials. A lower priming frequency 15 to 25 Hz was required to develop the initial cavity fill and eject air bubbles in the pump. After the pump is primed it is ready for fluid delivery on demand at the higher pump rate. The piezo assembly was stiffened against fracture by laminating a 25 um thick aluminum foil with a high temperature Kapton adhesive.

Further experiments tested the life cycle of the valves. A life test was run on the reed valves for $1\times10^9$ cycles without cracking the valves at 474 volts with only a loss of 10 micrometers of deflection on the valves over the life test. These settings are measurements were merely to test one embodiment of the internal pump assembly. No limitation to these settings is required, nor should such a requirement be implied. The element was laminated with 0.001 inch thick aluminum foil and bonded with a heat cured polyimide Kapton tape to further stabilize stress responses, prevent cracking at high drive voltages.

It will be appreciated that several of the above-disclosed and other features and functions, or alternatives thereof, may be desirably combined into many other different systems or applications. Also that various presently unforeseen or unanticipated alternatives, modifications, variations, or improvements therein may be subsequently made by those skilled in the art which are also intended to be encompassed by the following claims.

What is claimed is:

1. A print head pump assembly, comprising:

a piezo element plate having an array of piezoelectric elements;

a channel plate having an array of channel regions corresponding to the array of piezoelectric elements; and a valve plate having an array of reed valve pairs corresponding to the array of channel regions.

2. The print head pump assembly of claim 1, the print head pump assembly further comprising a low pressure ink reservoir to provide ink.

3. The print head pump assembly of claim 1, wherein the piezoelectric elements comprise flexible piezoelectric diaphragm elements.

4. The print head pump assembly of claim 1, wherein the channel regions comprise concave regions having flow channels within the concave regions.

5. The print head pump assembly of claim 1, wherein the reed valve pairs comprise an intake valve and an outlet valve.

6. The print head pump assembly of claim 5, wherein the channel plate comprises a first surface upon which the channel regions are arranged and a second surface upon which inlet and outlet seal ports are arranged to correspond with the intake and outlet valves.

7. The print head pump assembly of claim 6, wherein the seal ports have an annular area selected to overcome ink viscosity film adhesion forces and to form a seal that creates internal pressure such that a leak rate is controlled to prevent back flow of the ink during a purge cycle, without an anti-back flow check valve ball assembly.

* * * * *